United States Patent [19]

Knight et al.

[11] 4,445,520

[45] May 1, 1984

[54] CIGARETTE DETECTION AND REJECTION DEVICE

[75] Inventors: Raymond J. Knight, Richmond; Robert T. Mitten, Mechanicsville; Robert L. Ripley, Richmond, all of Va.

[73] Assignee: Philip Morris Incorporated, New York, N.Y.

[21] Appl. No.: 346,808

[22] Filed: Feb. 8, 1982

[51] Int. Cl.[3] ..... A24C 5/00; A24C 5/60

[52] U.S. Cl. ..... 131/282; 131/907

[58] Field of Search ..... 131/280, 282, 283, 907

[56] References Cited

U.S. PATENT DOCUMENTS

| | | | |
|---|---|---|---|
| 3,034,645 | 3/1960 | Groppe | 131/282 |
| 3,192,389 | 3/1962 | Schmermund | 131/907 |
| 3,237,764 | 11/1963 | Kochalski et al. | 131/282 |
| 3,360,658 | 6/1963 | Schmermund | 131/907 |
| 3,616,901 | 3/1970 | Groves | 131/907 |
| 3,672,373 | 1/1970 | Dogl et al. | 131/282 |
| 3,729,636 | 9/1971 | Merker | 131/907 |
| 3,812,349 | 4/1973 | Gugliotta et al. | 131/907 |
| 3,874,227 | 6/1973 | Focke | 131/907 |
| 3,874,391 | 5/1973 | Dogl et al. | 131/907 |
| 3,930,406 | 9/1974 | Pezzi | 131/282 |
| 3,980,567 | 3/1975 | Benini | 131/907 |
| 4,011,950 | 9/1975 | McLoughlin et al. | 131/907 |
| 4,090,794 | 6/1976 | Benini | 131/282 |
| 4,093,075 | 3/1977 | Molins | 131/282 |
| 4,168,641 | 12/1977 | Bryant | 131/907 |
| 4,209,955 | 5/1979 | Seragnoli | 131/282 |
| 4,266,674 | 5/1981 | Bell et al. | 131/282 |
| 4,306,445 | 4/1980 | Marsau et al. | 131/282 |
| 4,363,332 | 12/1981 | Preston et al. | 131/282 |

FOREIGN PATENT DOCUMENTS 1347221 4/1972 United Kingdom .

*Primary Examiner*—V. Millin

*Attorney, Agent, or Firm*—A. I. Palmer; N. A. Blish

[57] ABSTRACT

A cigarette testing device (10) detects improperly filled or missing cigarettes in groups of cigarettes in a cigarette packing machine. Tappets (20) are positioned against the ends of cigarettes (11) and the position of tappets (20) is determined by optical sensors (28). Defective cigarettes (15) are removed from the group by nozzles (24). One to one correspondence between cigarettes, tappets, sensors, and nozzle ejectors allows single defective cigarettes to be rejected without rejecting the entire group of cigarettes.

8 Claims, 6 Drawing Figures

CIGARETTE DETECTION AND REJECTION DEVICE

BACKGROUND OF THE INVENTION

This invention relates to methods and apparatus for automatically inspecting smoking articles and more particularly to methods and apparatus for detecting whether a cigarette is missing from a group or improperly filled prior to packaging.

DESCRIPTION OF THE PRIOR ART

In the production of cigarettes, defective cigarettes may occur because of malfunctions at various stages of the manufacturing process. Faults such as loosely packed cigarettes results in an unattractive product and a product that will have non-uniform smoking characteristics. An additional problem is that loosely filled cigarettes cannot be properly handled by cigarette packaging machinery.

Several techniques are known for detecting missing and improperly filled cigarettes and have been used with varying degrees of success. One method disclosed by Gugliotta et al, U.S. Pat. No. 3,812,349, discloses an optical inspection apparatus which includes a laser, an optic system and a photo detector to check light reflected from the tobacco in the end portion of a cigarette. However, only one cigarette at a time is inspected, which limits production speed.

Methods of testing cigarettes in a group are disclosed by Focke, U.S. Pat. No. 3,874,227; and Schmermund, U.S. Pat. No. 3,192,389. However, each of these methods use a device which rejects the entire group of cigarettes upon detection of a fault in a single cigarette. Rejection of a group of 20 cigarettes because of one faulty cigarette is both time consuming and expensive.

Other methods of detecting faults in cigarettes are used early in the manufacturing process, such as at the cigarette maker. These techniques while useful, ignore the fact that damage to the individual cigarettes may occur at some point in the manufacturing process between the cigarette maker and the cigarette packer.

Therefore, it is an object of the present invention to provide a method and apparatus for detecting faults in cigarettes at a point in the manufacturing process just prior to the cigarettes being placed in the package.

A further object of the present invention is to provide a method of testing individual cigarettes in a group and rejecting only faulty cigarettes rather than the entire group.

Another object of the present invention is to provide a method of testing groups of cigarettes in a rapid and accurate manner which is compatible with high speed cigarette manufacturing.

SUMMARY OF THE INVENTION

According to the present invention, the foregoing and other objects are attained by a cigarette detecting device which simultaneously tests a group of cigarette at one of the final stages of manufacturing prior to packaging the group in a cigarette package. The cigarette testing device consists of tappets which are pressed against the ends of the cigarettes to be tested; optical sensors to detect the position of the tappets; and air ejection nozzle which remove the defective cigarettes on the next cycle of the tester.

DESCRIPTION OF THE PREFERRED EMBODIMENT

Figure 1:
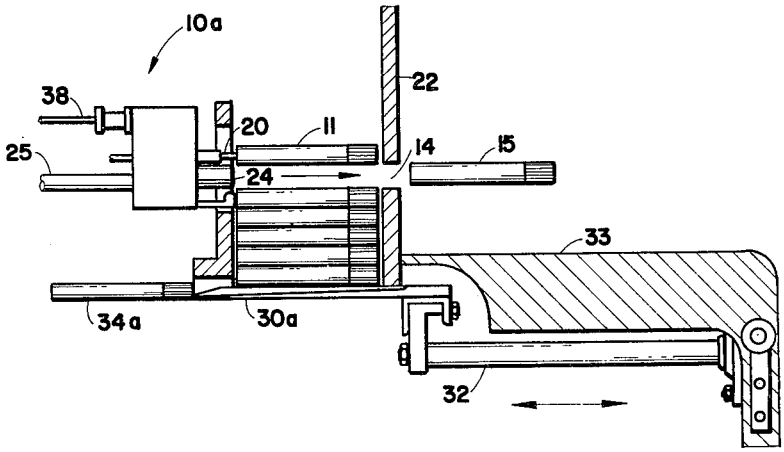
FIG. 1 is a prespective view from the side of a cigarette testing device according to the present invention.

Referring now to the drawings and more particularly to FIG. 1, there is illustrated a cigarette testing machine designated generally by reference numeral 10*a*. Cigarette testing device 10*a* is moved against a row of cigarettes 17*a*, shown in greater detail in FIG. 3, so that tappets 20 contact individual cigarettes 11.

Air nozzles 24 are aligned with the row of cigarettes directly below the row of cigarettes being tested by tappets 20. Defective cigarettes 15 are removed from the column of cigarettes by a jet of air from nozzles 24. Rejected cigarettes 15 are forced through aperture 14 in front plate 22. Although rejected cigarettes are removed directly below the tappets 20 in the preferred embodiment, the rejection nozzels 24 may be located at any position below tappets 20.

Groups of cigarettes that are satisfactory are removed at 34*a* by pusher plate 30*a*. Pusher plate 30*a* moves in a reciprocal fashion and is fixedly attached to cigarette pusher 32. Cigarette pusher 32 is covered by stationery protective cover 33.

Electrical input and output of the cigarette testing devide 10*a* is provided by cable 38 which will be described in more detail below. Air supply 25 provides air to nozzle 24 for removing defective cigarettes 15.

Figure 2:
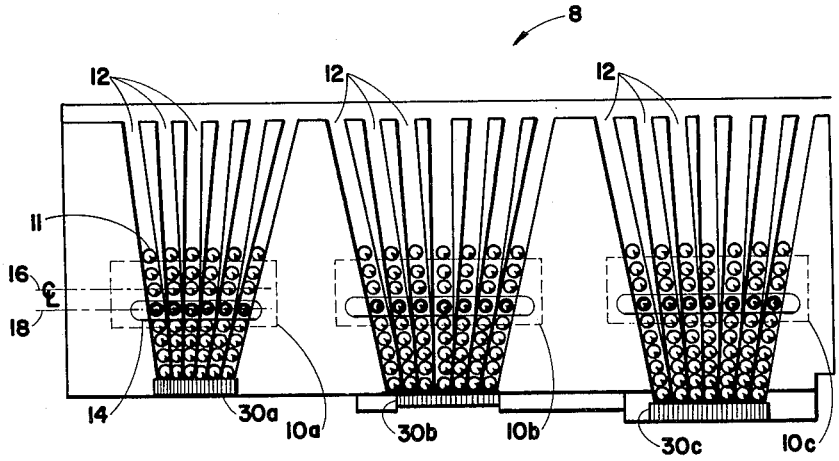
FIG. 2 is a front view of a cigarette hopper, partially in phantom, according to the present invention.

A front view of cigarette hopper 8, which consists of 3 groups of channels 12, is shown in FIG. 2. Cigarettes 11 are gravity fed to channels 12. The hopper 8 has twenty channels 12 divided into three groups, a group of six and two groups of seven. There are three cigarette testing devices 10*a–c*, shown in phantom, associated with cigarette hopper 8, one for each group of channels. Testing device 10*a* is associated with the group of six channels and cigarette testing device 10*b* and 10*c* are each associated with a group of seven channels.

Figure 3:
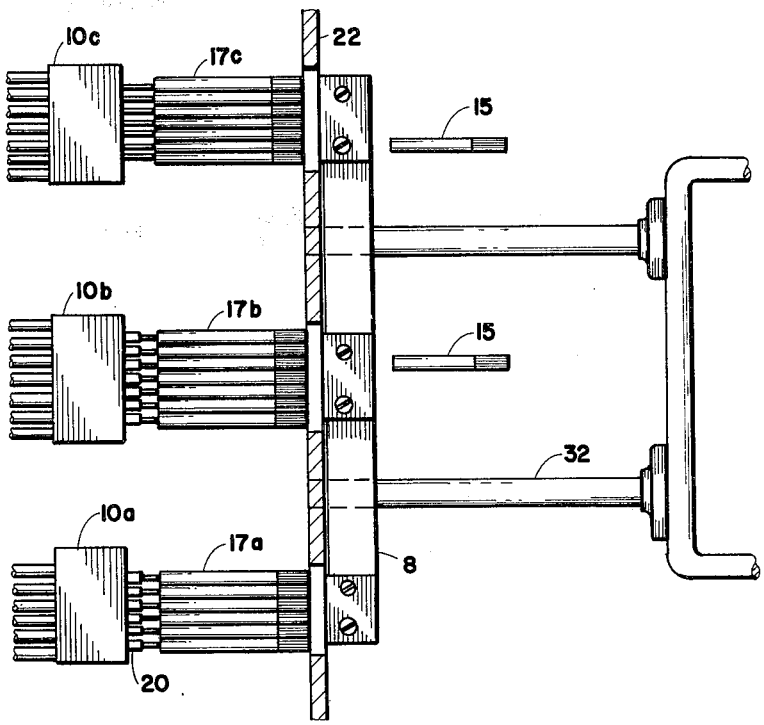
FIG. 3 is a view from above of the cigarette hopper shown in FIG. 2.

FIG. 3 shows cigarette hopper 8 from above. Cigarette pusher 32 operates the pusher plates 30*a–*30*c*, shown in FIG. 2, to remove groups of satisfactory cigarettes 34*a–*34*c* from channels 12.

Figure 4:
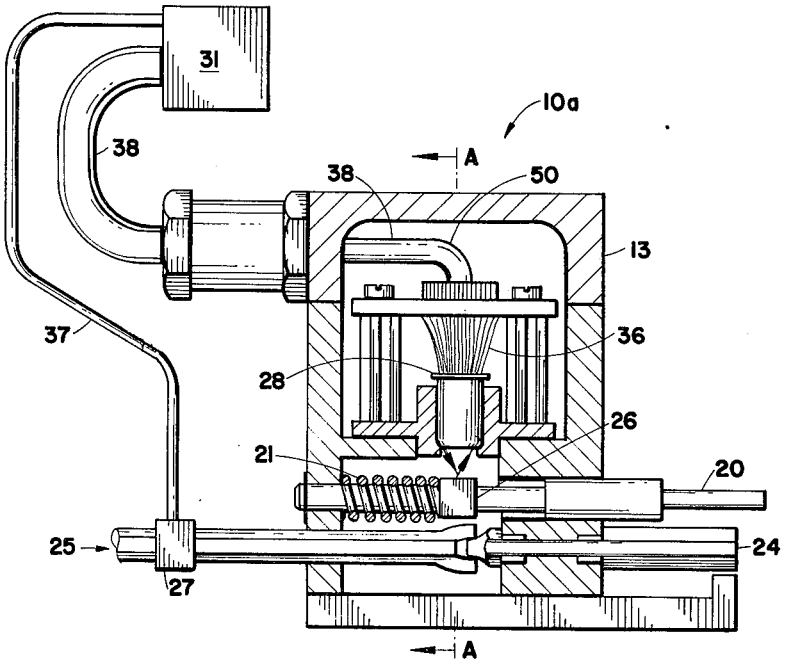
FIG. 4 is a sectional view from the side of a cigarette testing device according to the present invention.

Referring now to FIG. 4, a view of cigarette testing machine 10*a* from the side, partially in section, is shown. Cigarette testing devices 10*b* and 10*c* are similar. Housing 13 encloses and protects the components of cigarette testing device 10*a* and maintains them in proper relationship, as shown, tappet 20 is maintained in a forward position by bias spring 21. In the forward position, light from optical sensor 28 strikes reflective surface 26 and is reflected back to the optical sensor 28. In the preferred embodiment optical sensor 28 consists of a focused emitter and detector such as HEDS-1000 produced by Hewlett-Packard, 640 Page Mill Road, Palo Alto, Calif. Signals from optical sensor 28 are transmitted through wires 36, amplifer 50, cable 38 and connector 29, to logic circuit 31. Logic circuit 31 supplies an input signal via code 37 to solenoid air valve 27 for rejection of defective cigarettes 15.

Figure 5:
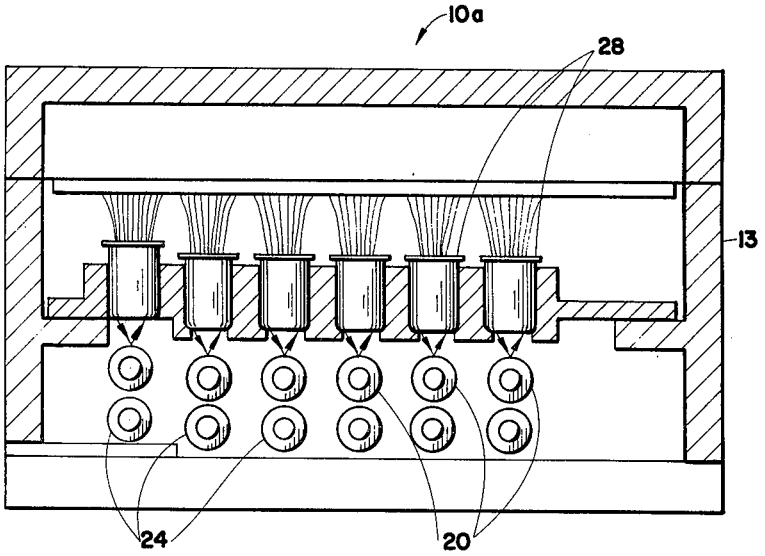
FIG. 5 is a sectional view along the lines A—A of the cigarette testing device shown in FIG. 4.

FIG. 5 shows cigarette testing device 10*a* from a front view along lines A—A of FIG. 4.

Figure 6:
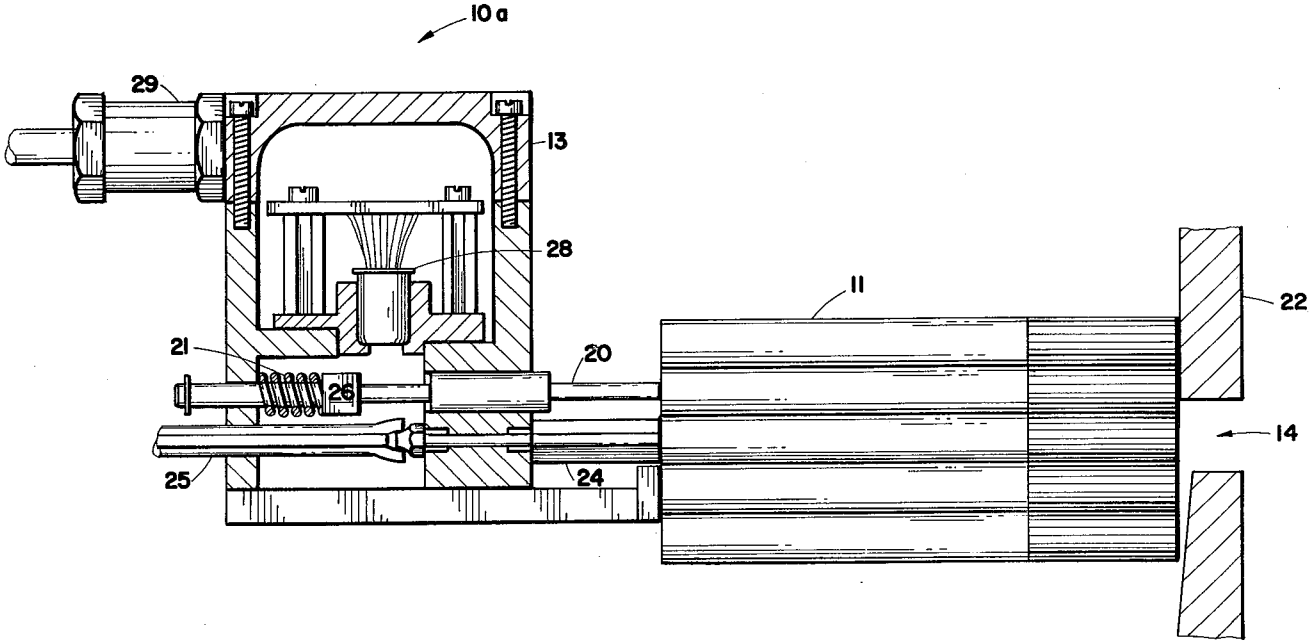
FIG. 6 is a side view, partially in section, of a cigarette testing device according to the present invention, in the test position.

FIG. 6 shows cigarette tester 10*a* after it has been moved into a position such that tappet 20 is in contact with a cigarette 11. Tappet 20 has been pushed to the rear by cigarette 11, moving reflective surface 26 from beneath optical sensor 28.

In operation, cigarette testing device 10*a* is moved forward such that tappets 20 contact cigarettes 11. If the individual cigarette 11 being tested is of the proper firmness, tappet 20 is forced in a rearward direction, compressing spring 21 as shown in FIG. 6. This moves reflective surface 26 from a position directly below optical sensor 28. In this position, light is no longer reflected back to optical sensor 28 by reflector surface 26 and the signal that reaches logic circuit 31 is that cigarette 11 is satisfactory.

As cigarette tester 10*a* is being moved against cigarette group 17*a*, cigarette pusher 32 cycles a group of satisfactory cigarettes 34*a* from beneath channels 12. As cigarette testing device 10*a* is retracted from contact with cigarette group 17*a*, pusher plate 30*a* is retracted and cigarettes 11 fall through channels 12 by force of gravity. In the retracted position, logic circuit 31 verifies that a light signal is being returned from reflector 26 indicating that tester 10*a* is operating properly.

The next cycle begins as cigarette testing device 10*a* is pressed into contact again with cigarette group 17*a*. At this point the cigarettes 11 which were tested in the above step by tappets 20 are now directly opposite nozzles 24. If the signal received by logic circuit 31 was that an individual cigarette in the group was defective, a blast of air from nozzle 24 would force cigarette 11 out aperture 14. Since a tappet 20 and an air nozzle 24 are associated with each of the 20 cigarettes in what will become a pack of cigarettes, individual defective cigarettes may be removed from the group.

Thus it is seen that individual defective cigarettes may be removed from a group of cigarettes without discarding the entire group of cigarettes. It is also seen that groups of cigarettes may be tested at a rapid production rate in conjunction with a high speed cigarette packaging machine.

I claim:

1. A cigarette testing device for cigarette packaging machines located at a point in the manufacturing process just before the cigarettes are placed into cigarette packages, for simultaneously testing the ends of cigarettes disposed in a group, said device comprising:

a support housing;

a plurality of tappets slidably disposed in said housing;

means for positioning said tappets against the ends of cigarettes in said group;

biasing means acting on said tappets for positioning said tappets in said housing;

detector means for detecting the position of each of said tappets; and rejection means for removing individual faulty cigarettes from a group.

2. A testing device as in claim 1 wherein said detecting means comprises an optical sensor.

3. A testing device as in claim 1 wherein said biasing means is a spring.

4. A testing device as in claim 1 wherein said rejection means is an air jet.

5. A testing device as in claim 6 wherein said rejection means is located below said tappets so that cigarettes tested by said tappets in one cycle are presented to said rejection means in the next cycle.

6. A testing device as in claim 1 wherein said rejection means is located below said tappets so that cigarettes tested by said tappets in one cycle are presented to said rejection means in a following cycle.

7. A cigarette testing device for cigarette packaging machines located at a point in the manufacturing process just before the cigarettes are placed into cigarette packages for simultaneously testing the ends of cigarettes disposed in a group, said device comprising:

a support housing;

a plurality of tappets slidably disposed in said housing;

means for positioning said tappets against the ends of cigarettes in said group;

biasing means acting on said tappets for positioning said tappets in said housing;

detector means for detecting the position of each of said tappets; and rejection means for removing individual faulty cigarettes from a group, located downstream from said tappets so that cigarettes tested by said tappets in one cycle are presented to said rejection means in the next cycle.

8. A cigarette testing device for cigarette packaging machines located at a point in the manufacturing process nust before the cigarettes are placed into cigarette packages for simultaneously testing the ends of cigarettes disposed in a group, said device comprising:

a support housing;

a plurality of tappets slidably disposed in said housing;

means for positioning said tappets against the ends of cigarettes in said group;

biasing means acting on said tappets for positioning said tappets in said housing;

detector means for detecting the position of each of said tappets; and rejection means for removing individual faulty cigarettes from a group, located downstream of said tappets so that cigarettes tested by said tappets in one cycle are presented to said rejection means in a following cycle.

* * * * *